United States Patent [19]

Kleinert

[11] 4,040,550

[45] Aug. 9, 1977

[54] BEER CASE AND SOFT DRINK CARTON CARRIER STRAP

[76] Inventor: Bernard L. Kleinert, 56937 State Road 123, South Bend, Ind. 46619

[21] Appl. No.: 694,948

[22] Filed: June 11, 1976

[51] Int. Cl.[2] ..... B65D 33/06

[52] U.S. Cl. ..... 224/45 P; 7/14.6; 81/3.46 R

[58] Field of Search ..... 224/45 P, 45 R, 45 A, 224/45 AA; 81/3.46 R, 3.1 R; 7/14.6; 294/16

[56] References Cited

U.S. PATENT DOCUMENTS 2,589,423 3/1952 Nadolsky ..... 81/3.1 R X 2,944,713 7/1960 Beach ..... 224/45 P

FOREIGN PATENT DOCUMENTS 699,533 11/1953 United Kingdom ..... 81/3.46

*Primary Examiner*—Robert J. Spar
*Assistant Examiner*—Donald W. Underwood

[57] ABSTRACT

This device consists primarily of a strap to which is secured fixedly, at each end, a metal hanger which will engage the openings in a beer case or soft drink carton, and the hook portions of the metal hangers are each provided with a recessed opening, which serves as a bottle opener.

1 Claim, 5 Drawing Figures

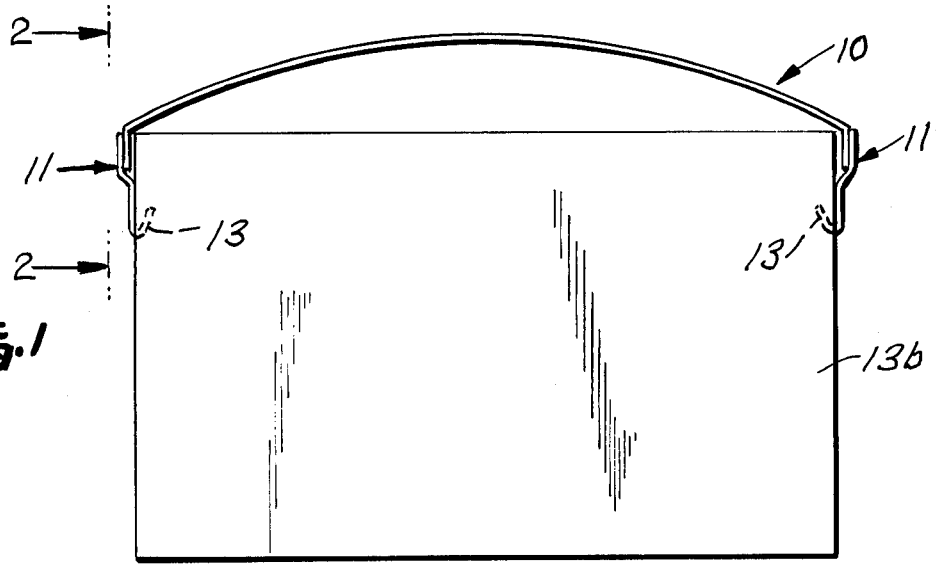
FIG. 1
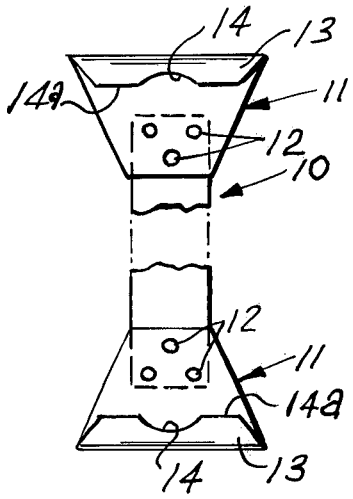
FIG. 4
FIG. 2
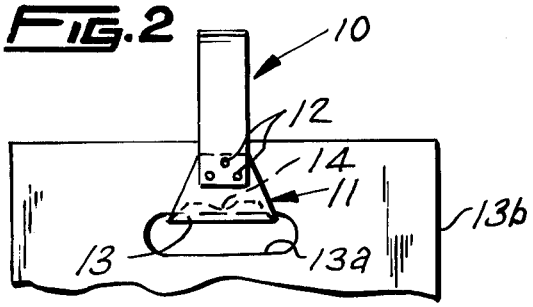
FIG. 3
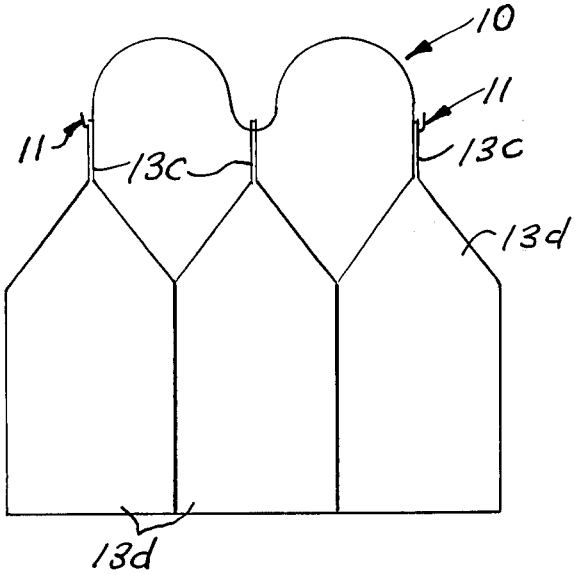
FIG. 5
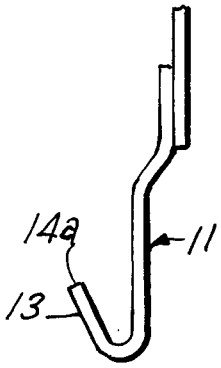

BEER CASE AND SOFT DRINK CARTON CARRIER STRAP

This invention relates to carrying devices, more particularly to a beer case and soft drink carton carrier strap.

It is therefore the principal object of this invention to provide a carrier strap, which will enable a person to carry a case or cartons with one hand, thus enabling the user to have the other hand free to open a car door, trunk, or house door without putting the case or carton down.

Another object of this invention is to provide a carrier strap of the type described, which will have the metal hangers, one on each end, having a bottle opening means.

A further object of this invention is to provide a carrier strap of the type described, which may be used to engage several cartons simultaneously.

Other objects of the invention are to provide a beer case and soft drink carton carrier strap, which is simple in design, inexpensive to manufacture, rugged in construction, easy to use and efficient in use.

These and other objects will be readily evident upon a study of the following specification and the accompanying drawing, wherein:

FIG. 1 is a side view of the present invention, shown secured to a beverage carton;

FIG. 2 is a view taken along the line 2—2 of FIG. 1;

FIG. 3 is a diagrammatic end view of a plurality of beverage cartons, showing the device secured thereto;

FIG. 4 is a bottom plan view of the invention, shown laid flat;

FIG. 5 is an enlarged fragmentary side view of the device.

According to this invention, a carrier strap 10 is shown to include a pair of metal hangers 11, one each being secured fixedly to an end of strap 10 by suitable rivet fasteners 12. The hook portions 13 of metal hangers 11 are received removably within the opening **13*a* of carton 13*b*, or, as shown in FIG. 3, strap 10 is secured as shown within the cut-outs of the upper extremities 13*c* of a plurality of cartons 13*b*.**

Referring now more particularly to FIGS. 2 and 4 of the drawing, it will be seen that a recessed opening 14 is centrally disposed on the peripheral edge **14*a* of the hook portion 13, so that strap 10 will double as bottle opening means, by the recessed opening 14** engaging with the underside of a cap on the bottle.

What I now claim:

1. A beer can and soft drink carton carrier strap assembly, comprising in combination, an elongated flat strap made of a flexible material, each opposite free end of said strap being permanently affixed by means of a plurality of rivet fasteners to one end of a metal hanger, each said metal hanger having a generally U-shaped transverse bend thereacross, said opposite free ends of said strap and said hangers together each forming a hook, an end edge of each said hook extending parallel to an axis of said bend, a generally semi-circular notch along a center of at least one of said hook end edges for engaging around a bottle neck below a crown cap for removal of said cap, said at least one of said hangers having a length that is less than a transverse width thereof whereby said hanger may be held in the palm of a hand adjacent the strap end such that a downward force applies leverage so as to remove said crown cap; said hangers at opposite ends of said assembly being engageable in handle openings provided on beverage cartons while said strap is slidable through said carton handle of an intermediate carton when more than two such cartons are carried adjacent each other.

* * * * *